US006746258B2

(12) United States Patent
Kikuchi et al.

(10) Patent No.: US 6,746,258 B2
(45) Date of Patent: Jun. 8, 2004

(54) ARC-RESISTANT STRUCTURE OF CONNECTOR

(75) Inventors: Hideaki Kikuchi, Shizuoka (JP); Yuzi Maeda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/238,588

(22) Filed: Sep. 11, 2002

(65) Prior Publication Data

US 2003/0049957 A1 Mar. 13, 2003

(30) Foreign Application Priority Data

Sep. 11, 2001 (JP) ..... P2001-275336

(51) Int. Cl.[7] ..... H01R 13/53

(52) U.S. Cl. ..... 439/181; 439/88; 439/180; 217/1

(58) Field of Search ..... 439/181, 38, 88, 439/87, 135, 180, 86, 90, 934, 183–187, 924.1, 851, 852, 438–441, 828, 834, 835, 701, 152, 155, 160; 218/1

(56) References Cited

U.S. PATENT DOCUMENTS 4,846,714 A * 7/1989 Welsby et al. ..... 439/348
4,927,374 A * 5/1990 Batty ..... 439/310
4,941,846 A * 7/1990 Guimond et al. ..... 439/578
5,655,916 A * 8/1997 Hayashi ..... 439/155
6,247,955 B1 * 6/2001 Yoshida et al. ..... 439/352
6,390,839 B2 * 5/2002 Miwa ..... 439/181
6,533,600 B1 * 3/2003 Kashiyama et al. ..... 439/352
6,537,092 B2 * 3/2003 Hirai et al. ..... 439/181
6,551,146 B2 * 4/2003 Nakamura ..... 439/752

FOREIGN PATENT DOCUMENTS

JP 10-302910 11/1998

* cited by examiner

*Primary Examiner*—Dean Reichard
*Assistant Examiner*—Angel R. Estrada
(74) *Attorney, Agent, or Firm*—Sughrue Mion, PLLC

(57) ABSTRACT

One of male and female connectors, which are to be fitted together, is provided with a high-speed connector-disengaging unit for increasing the connector-disengaging speed, utilizing a resilient force produced by a resilient deformation. More specifically, one of the male and female connectors, which are to be fitted together, includes a connector housing, a slider for sliding relative to the connector housing 6 in a connector disengaging direction during a connector disengaging operation, and a coil spring (resilient member) which is interposed between the connector housing and the slider, and is resiliently deformed to produce the resilient force when the slider is slid.

4 Claims, 8 Drawing Sheets

ARC-RESISTANT STRUCTURE OF CONNECTOR

BACKGROUND OF THE INVENTION

This invention relates to an arc-resistant structure of a connector in which a connector-disengaging speed is increased, utilizing a resilient force.

Description will be made, taking a vehicle as an example.

When a voltage of a vehicle power source is set to a value higher than a voltage of the current vehicle power source, wires, used in the electric wiring, can be reduced in diameter since a load current decreases. As a result, the weight of a wire harness can be reduced, and besides various advantages, including the improved efficiency of use of the power source, can be expected. Therefore, the possibility of increasing the vehicle power source voltage from the current value of DC 12V (effective voltage: 14V) to a higher value of DC 36V (effective voltage: 42V) has been studied.

The following problem is encountered with an electrically-connecting connector when the vehicle power source voltage is increased from the current value of DC 12V to the higher value of DC 36V. Namely, when the connector is inserted and disengaged in a voltage-applied condition (in the ON-state of a power system), an arc, which is larger in energy than that produced by the current vehicle power source, occurs, and as a result there arises a problem that terminals are broken by this arc.

There has been a technical report of countermeasures for such problem, in which magnets are provided respectively on opposite sides of a connector housing of a connector, and the adverse effects of an arc are lessened, utilizing the magnetic force of the magnets. However, this method has problems such as the greatly-increased cost, the increased size and the increased weight. And besides, in the case of a multi-pole connector, it is doubtful that the desired effect is obtained at those regions remote from the magnets.

The inventor of the present invention has grasped the following facts through experiments and so on. The first fact is that an arc is produced even with a small current when a voltage becomes high as will be appreciated from a graph of FIG. 9. The second fact is that an arc is liable to be produced at the time of disengagement of a connector. The third fact is that the lower the speed (test speed) of disengagement of the connector is, the larger the adverse effects (damage) become (since the duration of an arc discharge is increased) as will be appreciated from a graph of FIG. 10.

SUMMARY OF THE INVENTION

This invention has been made under the above circumstances, and an object of the invention is to provide an arc-resistant structure of a connector which can minimize adverse effects of an arc.

In order to solve the aforesaid object, the invention is characterized by having the following arrangement.

(1) An arc-resistant structure comprising a high-speed connector-disengaging unit, provided on one of male and female connectors which are to be fitted together, for increasing a speed of disengagement of the male and female connectors from each other by utilizing a resilient force produced by a resilient deformation.

(2) The arc-resistant structure according to (1), wherein the resilient force is not produced during the connector fitting operation.

(3) An arc-resistant structure comprising:

a connector housing provided on one of male and female connectors which are to be fitted together;

a slider for sliding relative to the connector housing in a connector disengaging direction during a connector disengaging operation; and a resilient member which is interposed between the connector housing and the slider and is resiliently deformed to produce a resilient force when the slider is slid.

(4) The arc-resistant structure according to (3), wherein the resilient force is not produced during a connector fitting operation.

(5) The arc-resistant structure according to (3), wherein the connector housing includes a housing projecting portion, the slider includes first and second slider projecting portions between which the resilient member is interposed, one end of the resilient member is fixed to the housing projecting portion and the other end of the resilient member is fixed to the first slider projecting portion, and the second slider projecting portion is adapted to be brought in contact with the housing projecting portion.

(6) The arc-resistant structure according to (5), wherein the second slider projecting portion is brought in contact with the housing projecting portion during a connector fitting operation, and is separated from the housing projecting portion during the connector disengaging operation.

DETAILED DESCRIPTION OF PREFERRED EMBODIMENTS

Figure 1:
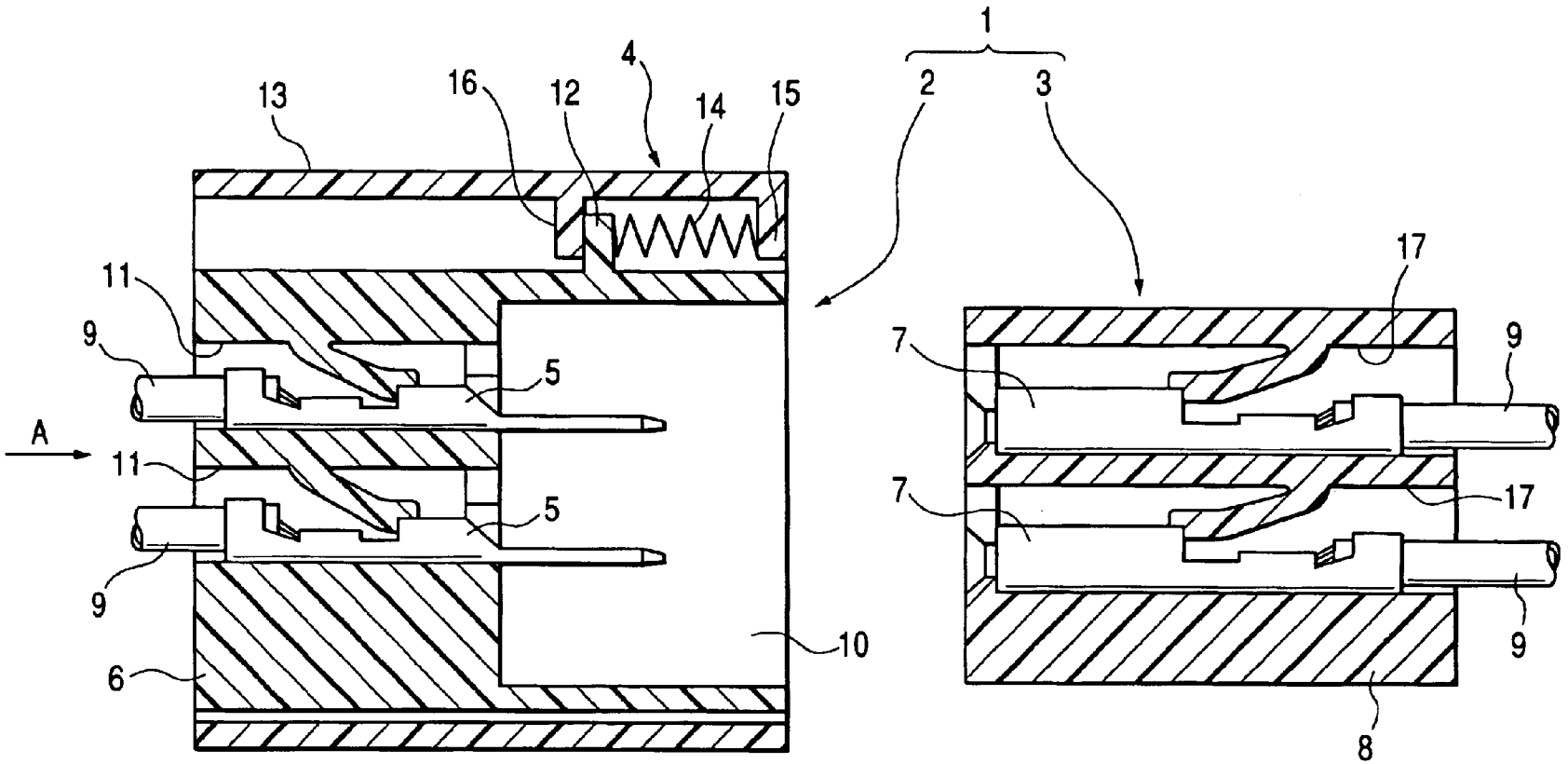
FIG. 1 is a cross-sectional view showing one preferred embodiment of an arc-resistant structure of a connector of the invention.

A preferred embodiment of the present invention will now be described with reference to the drawings. FIG. 1 is a cross-sectional view showing one preferred embodiment of an arc-resistant structure of a connector of the invention.

In FIG. 1, reference numeral 1 denotes an electrically-connecting connector provided, for example, on a high-voltage circuit of a vehicle. The connector 1 comprises a male connector 2 and a female connector 3 which are to be fitted together. The connector 1 is provided with a high-speed connector-disengaging unit 4 for increasing the connector-disengaging speed so as to suppress adverse influence of an arc to a minimum.

The male connector 2 comprises a plurality of, (or one) male terminals 5, and a connector housing 6 made of a synthetic resin. The female connector 3 comprises a plurality of (or one) female terminals 7, and a connector housing 8 made of a synthetic resin. In this specification, the connector, having the male terminals, is defined as the male connector, while the connector, having the female terminals, is defined as the female connector.

First, the constructions of the above parts will be described in detail.

The male terminal 5 is of a known construction, and includes an electrical contact portion, and a wire connection portion connected to a wire 9 by pressing. A front portion of the electrical contact portion is formed into a bar-like shape, and can be contacted with a resilient contact piece portion (described later) of the female terminal 7. A rear end portion of the electrical contact portion can be retained by a retaining projection (lance) (described later) of the connector housing 6.

The connector housing 6 includes a fitting portion 10, into which the female connector 3 can be inserted and fitted in the connector-fitting operation, and terminal receiving chambers 11 arranged in two (upper and lower) rows for respectively receiving the plurality of male terminals 5. A lock unit for the connector housing 8 is provided at the fitting portion 10. A housing projecting portion 12, forming the high-speed connector-disengaging unit 4, is formed on an upper surface of the fitting portion 10. The high-speed connector-disengaging unit 4 will be described later.

Each terminal receiving chamber 11 is defined by a space extending in a forward-rearward direction of the connector housing 6, and male terminal outlet ports, open to an inner end surface of the fitting portion 10, communicate with these chambers 11, respectively. Male terminal insertion ports, open to the rear end surface of the connector housing 6, communicates with the terminal receiving chambers 11, respectively. In FIG. 1, the wires 9 are led out through the male terminal insertion ports, respectively. The retaining projection (lance) for preventing the withdrawal of the male terminal 5 is provided within the terminal receiving chamber 11. When the male terminal 5 is received in the terminal receiving chamber 5, the bar-like electrical contact portion of the male terminal 5 projects into the interior of the fitting portion 10.

In this embodiment, the high-speed connector-disengaging unit 4 is provided on the male connector 2. This high-speed connector-disengaging unit 4 serves to increase the connector-disengaging speed, utilizing a resilient force produced by a resilient deformation, and this unit 4 comprises the housing projecting portion 12, a slider 13, and a coil spring (resilient member) 14.

One end of the coil spring 14 is fixedly secured to a front surface of the housing projecting portion 12. A rear surface of the housing projecting portion 12 functions as a stopper for the slider 13, urged by the coil spring 14, and also serves as an abutment surface when the connectors are fitted together. Any limitation is imposed on the position and configuration of the housing projecting portion 12 in so far as it can perform the above functions.

The slider 13 is mounted on the outer periphery of the connector housing 6, and can slide relative to the connector housing 6 in a connector-disengaging direction when the two connectors are disengaged from each other. In this embodiment, the slider is in the form of a generally rectangular tubular casing having open front and rear ends.

A slider first projecting portion 15 and a slider second projecting portion 16 are formed on an inner surface of an upper wall of the slider 13, and are spaced a predetermined distance from each other. The slider first projecting portion 15 is formed at the front end of the slider 13, and the other end of the coil spring 14 is fixedly secured to a rear surface thereof. The slider second projecting portion 16 is formed intermediate the opposite ends of the slider 13, and a front surface thereof can abut against the rear surface of the housing projecting portion 12.

The arrangement of the slider fist projecting portion 15 and slider second projecting portion 16 is determined in accordance with the position of the housing projecting portion 12 and the resilient force of the coil spring 14. Their configuration corresponds to that of the housing projecting portion 12, and is not particularly limited to any specified shape.

Although not particularly shown in the drawings, an anti-slip unit for preventing the slipping of the hand on the slider 13 at the time of the operation is provided on the outer surface of the slider 13.

As described above, the coil spring 14 is interposed between the connector housing 6 and the slider 13, and when the slider 13 is slid in the connector-disengaging direction, this coil spring is resiliently deformed (compressed) to produce a resilient force. The resilient force of the coil spring 14 will be described later. Any other suitable resilient member, such as a leaf spring or a rubber member, may be used in so far as it performs the same function as that of the coil spring 14.

The female terminal 7 is of a known construction, and for example, it includes an electrical contact portion of a generally box-shape, and a wire connection portion connected to a wire 9 by pressing. This electrical contact portion, for example, has an open front end, and the resilient contact piece portion is formed within this electrical contact portion. A rear end of the electrical contact portion can be retained by a retaining projection (lance) on the connector housing 8.

The connector housing 8 has a generally rectangular shape, and a plurality of terminal receiving chambers 17 are formed within this connector housing, and are arranged in two (upper and lower) rows. Each terminal receiving chamber 17 is defined by a space extending in a forward-rearward direction of the connector housing 8, and male terminal insertion ports, formed in the front end of the connector housing 8, communicate with these chambers 17, respectively. Female terminal insertion ports, open to the rear end surface of the connector housing 8, communicate with the terminal receiving chambers 17, respectively. In FIG. 1, the wires 9 are led out through the female terminal insertion ports, respectively. The retaining projection (lance) for preventing the withdrawal of the female terminal 7 is formed within the terminal receiving chamber 17.

A lock unit (not shown), corresponding to the lock unit provided on the connector housing 6 of the male connector 2, is provided on the connector housing 8.

In the above construction, the connector fitting operation and the connector disengaging operation, effected by the male and female connectors 2 and 3, will be described.

Figure 2:
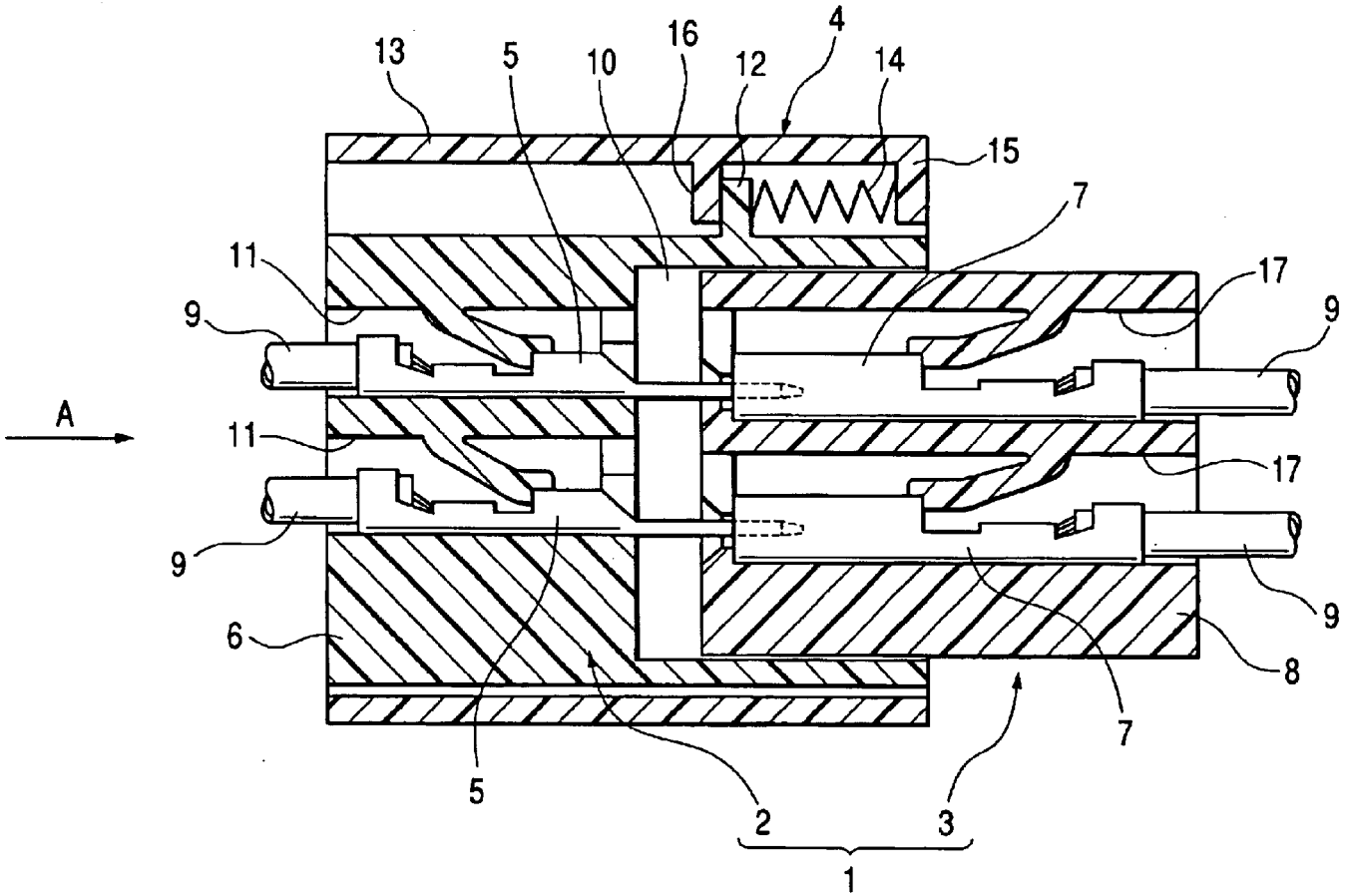
FIG. 2 is a cross-sectional view showing a condition in which connectors are in the process of being fitted together.
Figure 3:
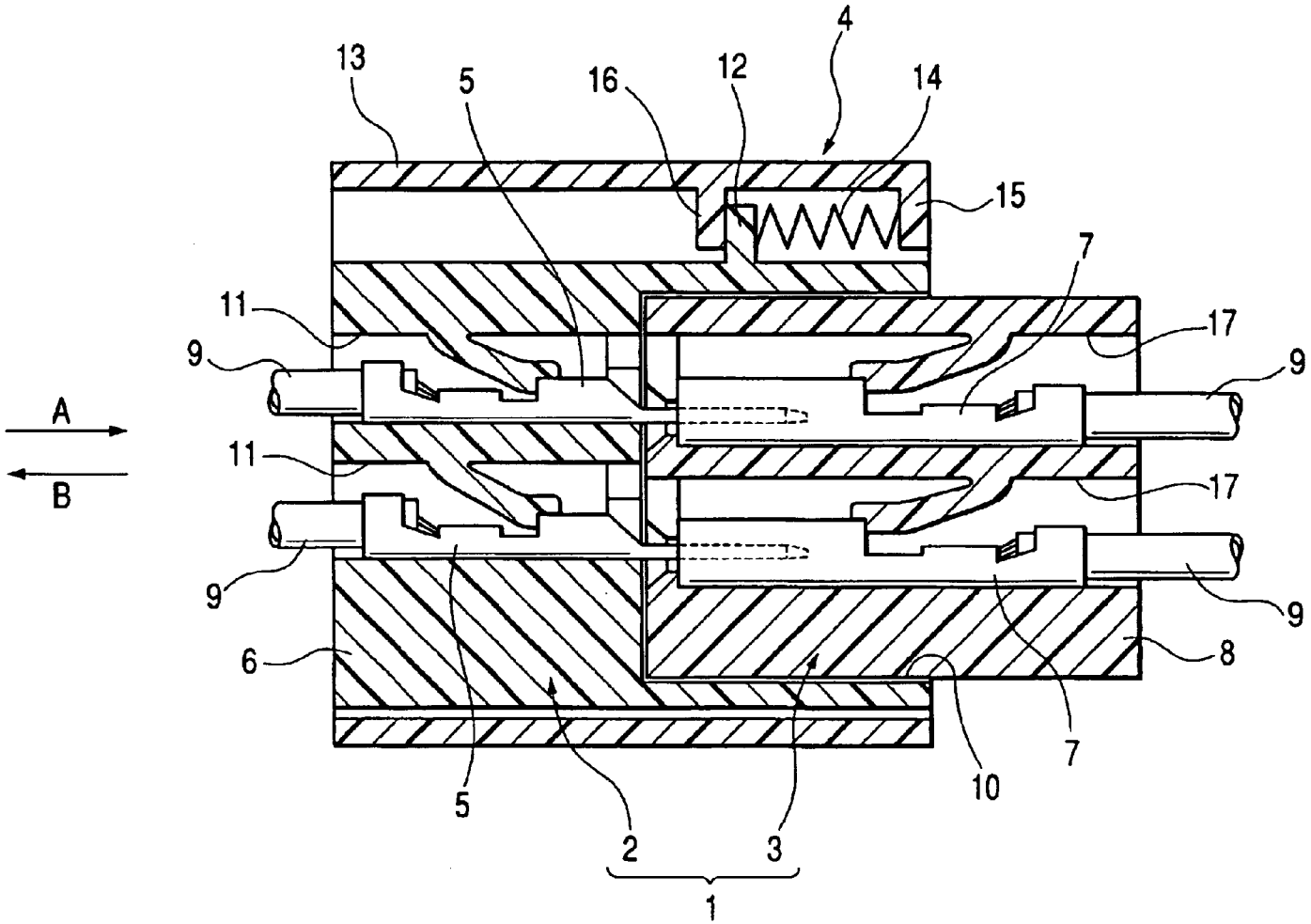
FIG. 3 is a cross-sectional view showing a condition in which the connector fitting operation is completed.
Figure 4:
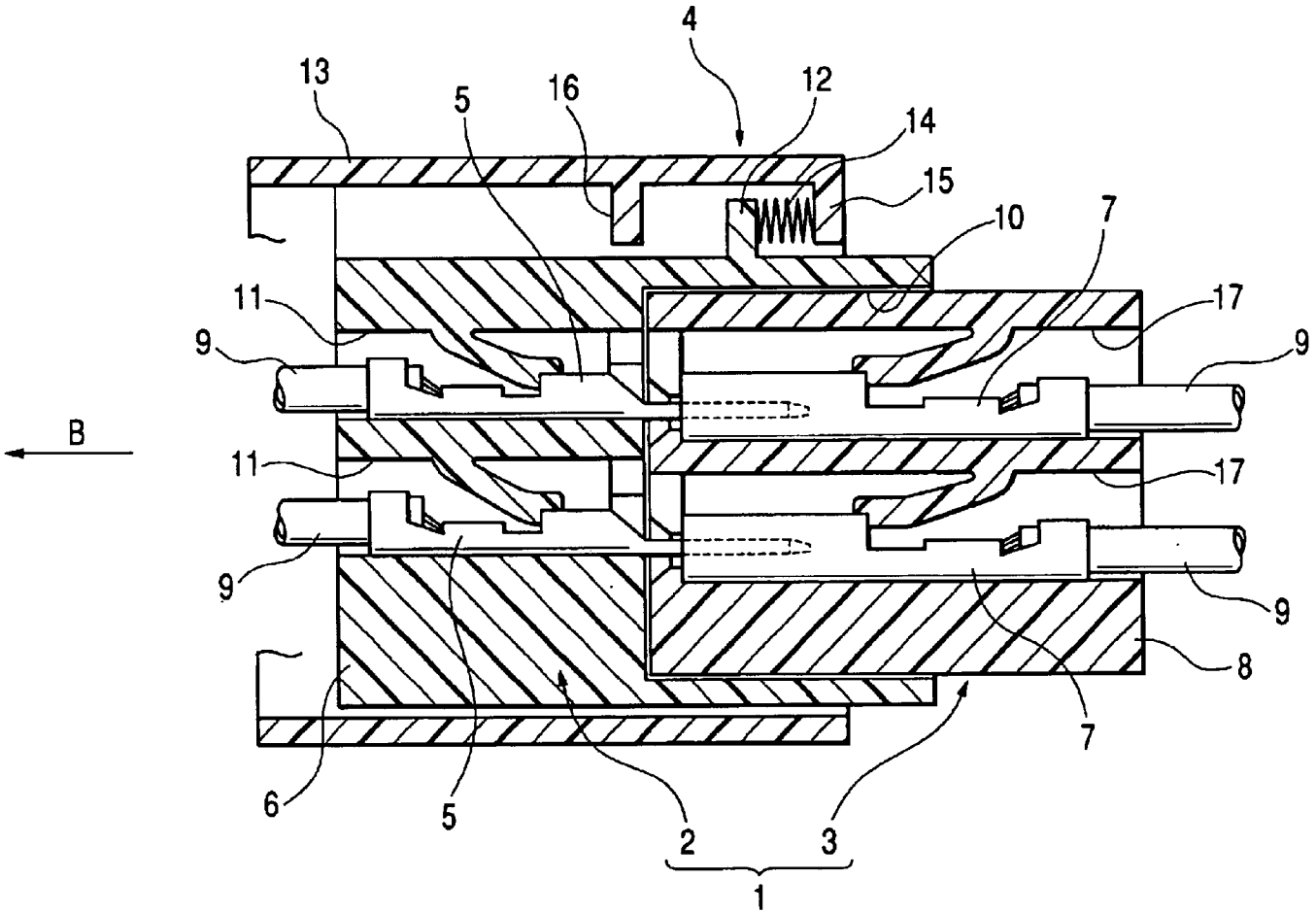
FIG. 4 is a cross-sectional view showing a condition immediately after the connector disengaging operation is started.
Figure 5:
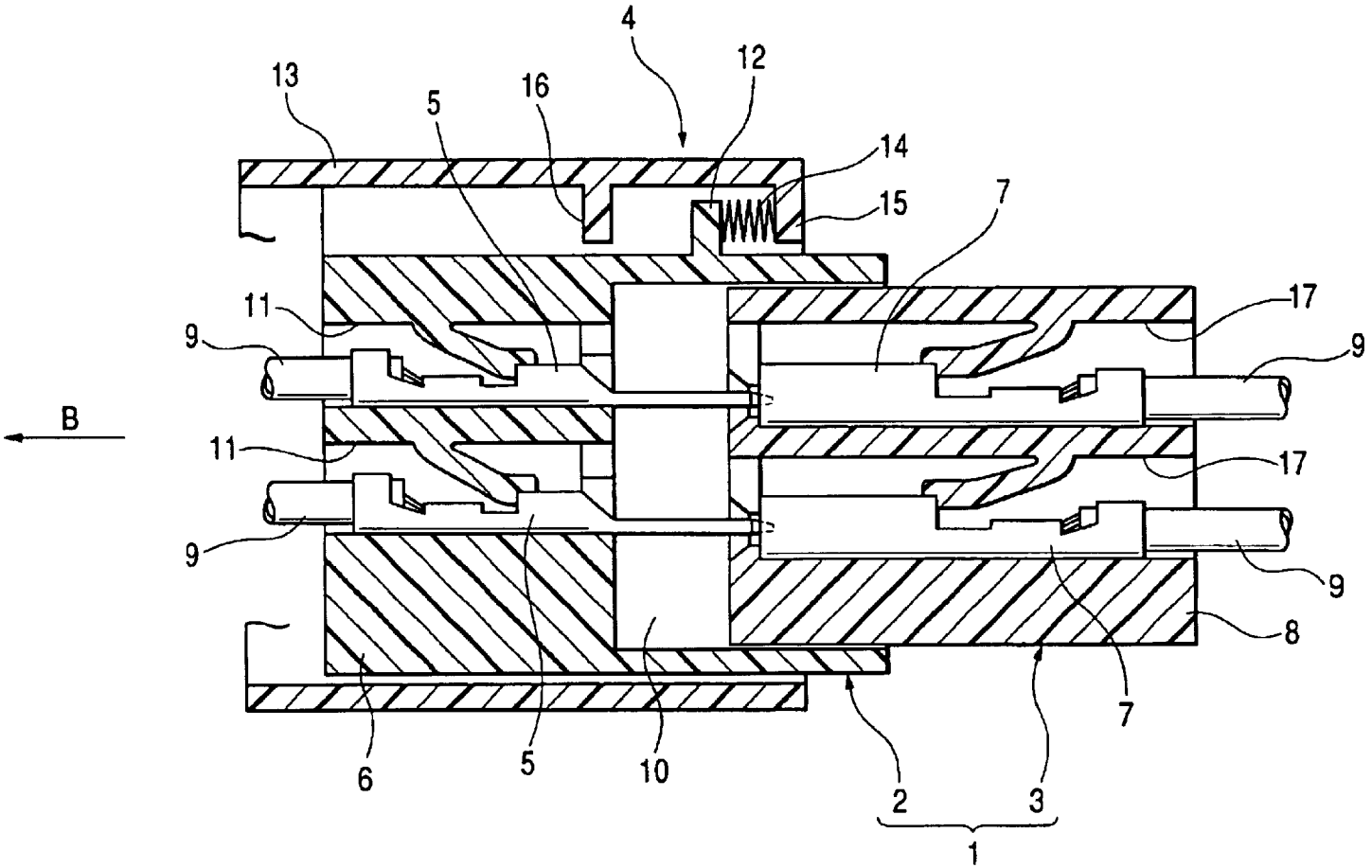
FIG. 5 is a cross-sectional view showing a condition in which the connectors are in the process of being disengaged from each other.
Figure 6:
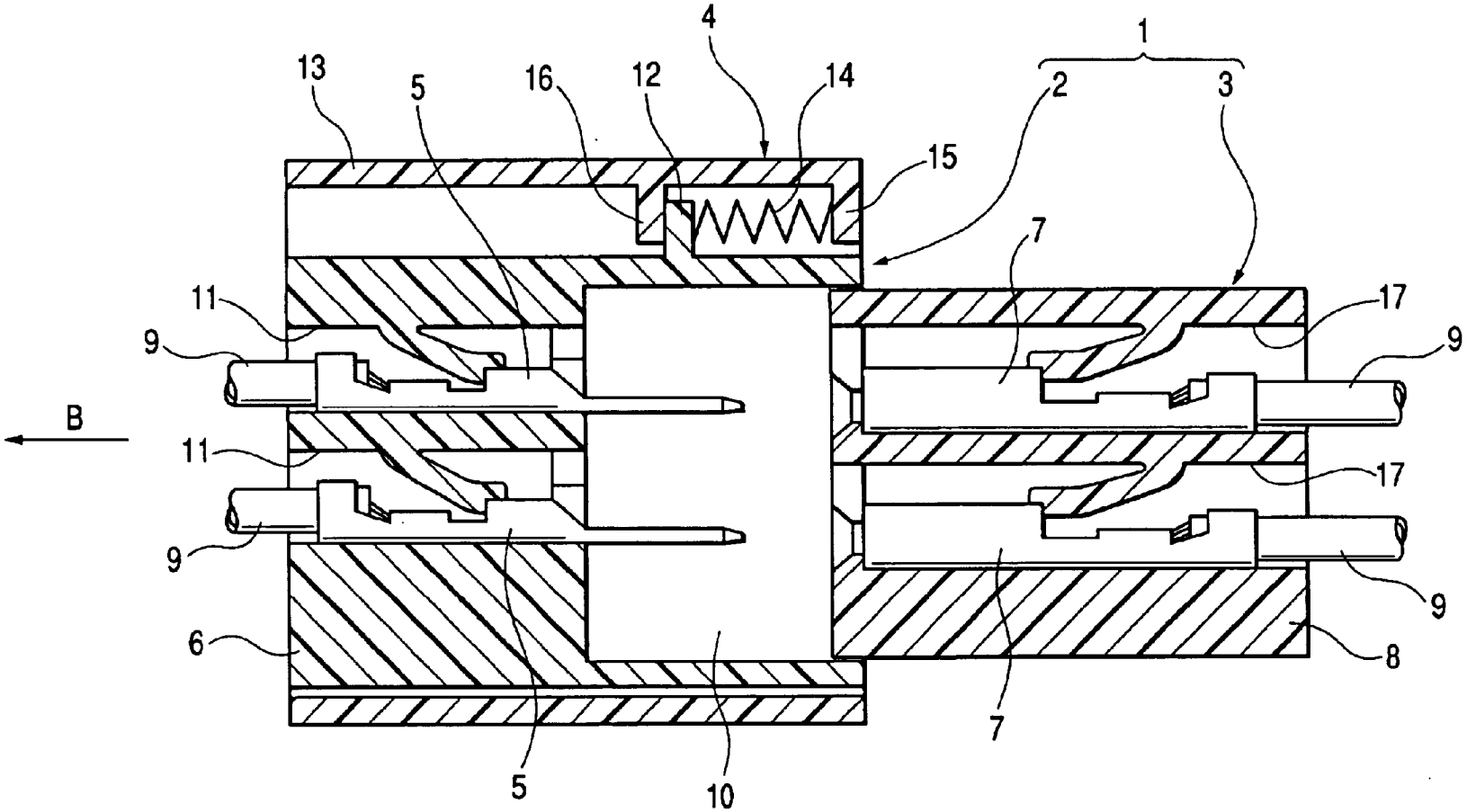
FIG. 6 is a cross-sectional view showing a condition in which the connectors are disengaged from each other.

FIG. 2 is a cross-sectional view showing a condition in which the connectors are in the process of being fitted together, FIG. 3 is a cross-sectional view showing a condition in which the connector fitting operation is completed, FIG. 4 is a cross-sectional view showing a condition immediately after the connector disengaging operation is started, FIG. 5 is a cross-sectional view showing a condition in which the connectors are in the process of being disengaged from each other, and FIG. 6 is a cross-sectional view showing a condition in which the connectors are disengaged from each other.

Connector Fitting Operation

The male connector 2 and the female connector 3 are arranged as shown in FIG. 1. At this time, the female connector 3 is held by one hand of the operator. The outer side of the slider 13 is held by the other hand.

In this condition, when the other hand of the operator is moved in a direction of arrow A, the slider second projecting portion 16 of the slider 13 abuts against the housing projecting portion 12, so that the male connector 2 is moved in the direction of arrow A.

Then, the fitting portion 10 of the connector housing 6 is fitted on the female connector 3, and the male terminals 5 are brought into contact with the female terminals 7, respectively, so that the male connector 2 and the female connector 3 are in an initially-fitted condition as shown in FIG. 2.

During the above movement in the direction of arrow A, the slider 13 does not slide relative to the connector housing 6, and therefore the coil spring 14 is not resiliently deformed.

In the above initially-fitted condition, when the male connector is further pushed in the direction of arrow A with a force larger than a terminal-fitting force (a pressure of contact of the male terminals with the female terminals), the connector fitting operation is completed as shown in FIG. 3. At this time, the female connector 3 is completely fitted into the fitting portion 10 of the connector housing 6, so that the male terminals 5 are connected to the female terminals 7, respectively.

Connector Disengaging Operation

In FIG. 3, the female connector 3 is held by the one hand of the operator. The outer side of the slider 13 is held by the other hand. In this condition, when the other hand of the operator is moved in a direction of arrow B (in the connector disengaging direction), only the slider 13 is slid relative to the connector housing 6 in the direction of arrow B while the male connector 2 is not moved in the direction of arrow B since the terminal-fitting force is larger than the resilient force of the coil spring 14. Namely, the coil spring 14 is resiliently deformed, so that only the slider 13 is slid relative to the connector housing 6 in the direction of arrow B.

Then, when the coil spring 14 is compressed to be sufficiently resiliently deformed as shown in FIG. 4, the disengaging force in the direction of arrow B becomes larger than the terminal-fitting force, so that the male connector 2 begins to be disengaged from the female connector 3 as shown in FIG. 5. At this time, the terminal-fitting force gradually decreases as this movement proceeds.

Thereafter, at the time when the male terminals 5 are disengaged respectively from the female terminals 7, or at the time when the resilient force of the coil spring 14 becomes larger than the terminal-fitting force, this resilient force acts on the male connector 2, so that the connector-disengaging speed at the time of disengagement of the male terminals 5 from the respective female terminals 7 is accelerated into a speed larger than a predetermined value, and the connector disengaging operation is completed as shown in FIG. 6.

Figure 7:
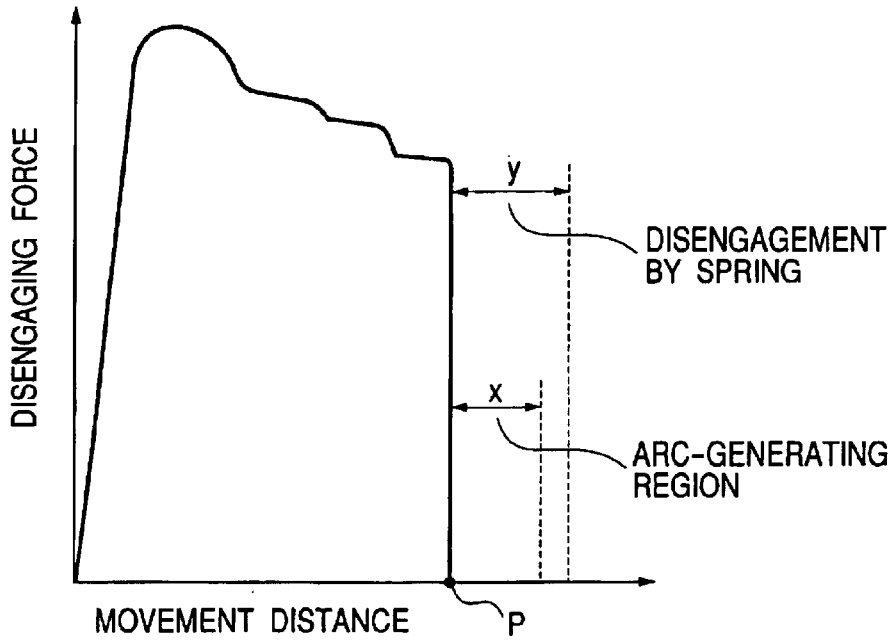
FIG. 7 is a diagram showing the relation between the movement distance and a disengaging force in the connector disengaging operation.
Figure 8:
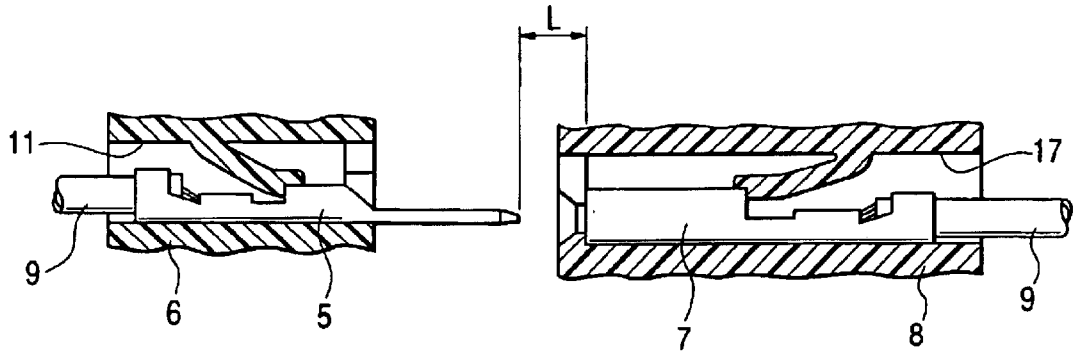
FIG. 8 is a view explanatory of the disengagement distance from the terminal disengaging point and the arc-generating distance.
Figure 9:
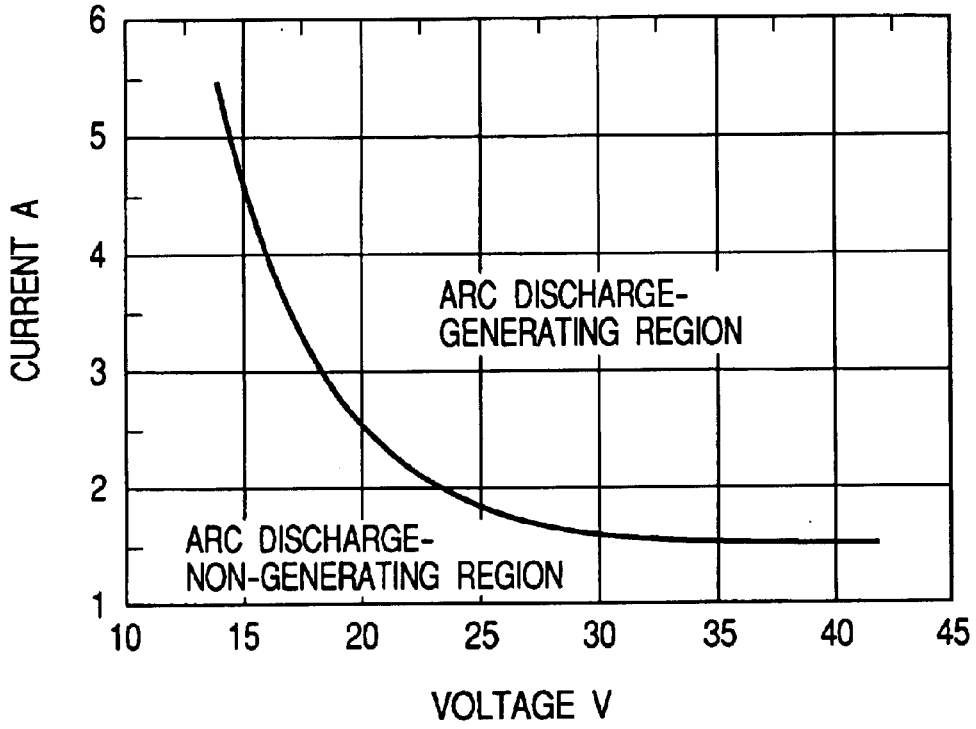
FIG. 9 is a diagram showing an arc discharge-generating region, using the relation between a voltage and a current.
Figure 10:
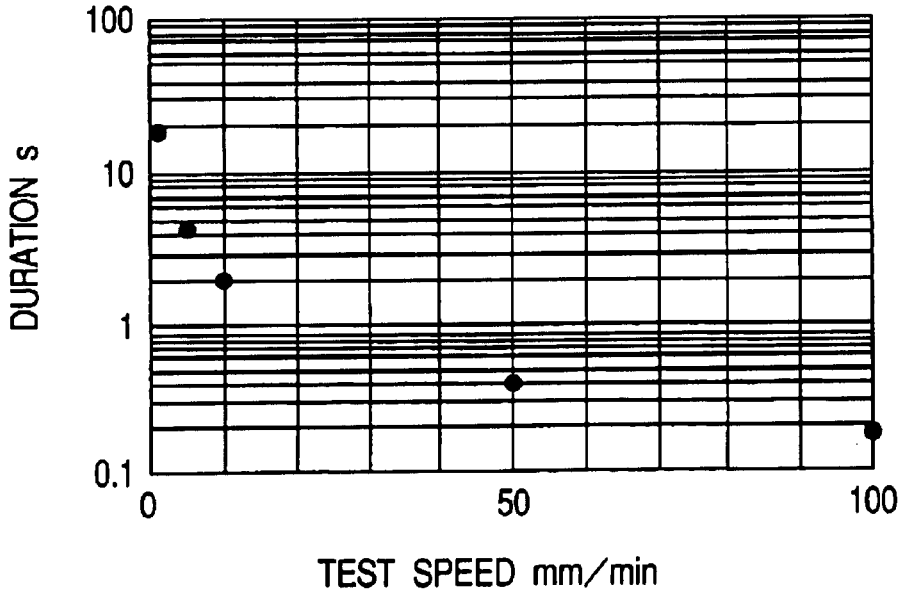
FIG. 10 is a diagram showing the relation between a test speed and the duration.

The relation between the movement distance and the disengaging force in the above process (the connector disengaging process) is shown in FIG. 7. This indicates that an arc is generated when the distance L (see FIG. 8) from the terminal disengaging point P is within the range x. In the present invention, because of the resilient force of the coil spring 14 (see FIG. 1), the distance L between each male terminal 5 and the corresponding female terminal 7 becomes y (see FIG. 7.) which is larger than the above x, as shown in FIG. 8.

As described above, thanks to the provision of the high-speed connector-disengaging unit 4, the connector-disengaging speed can be increased. Therefore, the duration of the arc discharge can be shortened, thereby suppressing the adverse effects of the arc to a minimum. And besides, in this structure, the resilient force of the coil spring 14 is not produced during the connector fitting operation, and therefore the operability of the connecting fitting operation will not be affected.

For example, even when the disengagement is effected by moving the male connector at a low speed in the direction of arrow B (When such a disengaging method is used in the conventional connector, an arc is generated to damage the terminals to such a degree as to disenable the insertion and withdrawal of the terminals.), the above resilient force acts at the time of disengagement of the two connectors from each other, thereby securing the disengaging speed of above the predetermined value.

Various changes can be made within the scope of the invention. For example, the high-speed connector-disengaging unit 4 may be provided on the female connector 3.

As described above, in the invention, the connector-disengaging speed is increased thanks to the provision of the high-speed connector-disengaging unit. Therefore, the duration of the arc discharge is shortened, thereby suppressing the adverse effects of the arc to a minimum.

In the invention, one of the male and female connectors to be fitted together comprises the connector housing, the slider, and the resilient member, and with this construction, the connector-disengaging speed can be increased. Therefore, the duration of the arc discharge is shortened, thereby suppressing the adverse effects of the arc to a minimum.

In the invention, there is achieved an advantage that the operability of the connector fitting operation will not be affected.

What is claimed is:

1. An arc-resistant structure comprising:

a connector housing provided on one of male and female connectors which are to be fitted together;

a slider for sliding relative to the connector housing in a connector disengaging direction during a connector disengaging operation; and a resilient member which is interposed between the connector housing and the slider and is resiliently deformed to produce a resilient force when the slider is slid, wherein the resilient force is produced by the resilient deformation of a resilient member, and wherein the resilient member and the high-speed connector-disengaging unit are configured to not produce the resilient force during a connector fitting operation.

2. An arc-resistant structure comprising:

a connector housing provided on one of male and female connectors which are to be fitted together;

a slider for sliding relative to the connector housing in a connector disengaging direction during a connector disengaging operation; and a resilient member which is interposed between the connector housing and the slider and is resiliently deformed to produce a resilient force when the slider is slid, wherein the connector housing includes a housing projecting portion, the slider includes first and second slider projecting portions between which the resilient member is interposed, one end of the resilient member is fixed to the housing projecting portion and the other end of the resilient member is fixed to the first slider projecting portion, and the second slider projecting portion is adapted to be brought in contact with the housing projecting portion.

3. The arc-resistant structure according to claim 2, wherein the second slider projecting portion is brought in contact with the housing projecting portion during a connector fitting operation, and is separated from the housing projecting portion during the connector disengaging operation.

4. An arc-resistant structure comprising a high-speed connector-disengaging unit, provided on one of male and female connectors which are to be fitted together, for increasing a speed of disengagement of the male and female connectors from each other by utilizing a resilient force produced by a resilient deformation, wherein the resilient force is produced by the resilient deformation of a resilient member, and wherein the resilient member and the high-speed connector-disengaging unit are configured to not produce the resilient force during a connector fitting operation.

* * * * *